United States Patent [19]

Bernath

[11] Patent Number: 4,681,003

[45] Date of Patent: Jul. 21, 1987

[54] MECHANISM FOR DEPOSITION OF SHEET METAL

[75] Inventor: Oskar Bernath, Umiken, Switzerland

[73] Assignee: Georg Fischer Aktiegesellschaft Brugg, Brugg, Switzerland

[21] Appl. No.: 831,107

[22] Filed: Feb. 19, 1986

Related U.S. Application Data

[63] Continuation of Ser. No. 603,635, Apr. 25, 1984, abandoned.

[30] Foreign Application Priority Data

Apr. 26, 1983 [CH] Switzerland ..... 2222/83

[51] Int. Cl.[4] ..... B26D 7/06

[52] U.S. Cl. ..... 83/80; 83/94; 83/157; 83/210; 271/191

[58] Field of Search ..... 271/6, 7, 185, 186, 271/184, 191, 198, 200, 202; 83/82, 94, 157, 208, 369

[56] References Cited

U.S. PATENT DOCUMENTS

| | | | |
|---|---|---|---|
| 430,378 | 6/1890 | Cottrell | 271/191 |
| 935,538 | 9/1909 | North | 271/191 |
| 2,549,202 | 4/1951 | Idelman | 271/191 |
| 3,271,027 | 9/1966 | Liedl et al. | 271/191 |
| 3,318,179 | 5/1967 | Elsas | 83/208 |
| 3,715,944 | 2/1973 | Kwechtel et al. | 83/208 |
| 3,906,825 | 9/1975 | Schenck et al. | 83/208 |
| 4,127,264 | 11/1978 | Fayolle | 271/191 |
| 4,151,906 | 5/1979 | Pfeiffer et al. | 271/191 |
| 4,185,815 | 1/1980 | Abbott et al. | 271/191 |

FOREIGN PATENT DOCUMENTS

| | | | |
|---|---|---|---|
| 1132861 | 7/1962 | Fed. Rep. of Germany . | |
| 2124177 | 11/1972 | Fed. Rep. of Germany . | |
| 2201396 | 7/1975 | Fed. Rep. of Germany . | |
| 7707745 | 10/1978 | France . | |
| 7820945 | 2/1980 | France . | |
| 1130582 | 10/1968 | United Kingdom | 271/68 |

*Primary Examiner*—H. Grant Skaggs, Jr.
*Attorney, Agent, or Firm*—Toren, McGeady & Associates

[57] ABSTRACT

A mechanism for depositing sheet material including a continuous belt extending between a pair of deflection rollers maintained in taut engagement thereabout, with one of the rollers being reciprocally movable relative to the other for expanding and contracting the length of the support surface in order to transport and deposit sheet material held on the support surface. A clamping mechanism operates to hold the belt stationary relative to the other of the deflection rollers when the one deflection roller is moved to contract the length of the support surface.

11 Claims, 6 Drawing Figures

MECHANISM FOR DEPOSITION OF SHEET METAL

This is a continution of application Ser. No. 603,635, filed Apr. 25, 1984, now abandoned.

The present invention is directed generally to a device for transporting and depositing sheet material such as planar or lamellar workpieces, particularly veneer pieces.

A device of the type to which the present invention relates is known from DE-GbM No. 69 15 362 which discloses a mechanism wherein a belt or band serving as a workpiece support is fastened at one end to a stationary frame and at another end at a wind-on roller which is longitudinally movable with a sled or carriage and which is compulsorily rotatable by means of the longitudinal movement thereof. In the device described, the belt is wound on and off, respectively, and it does not move with respect to the frame even during forward running of the sled, i.e., it cannot run with the forward feed speed of the veneer belt or band. The veneer belt must slide on the depositing device.

Accordingly, it occurs that in practice overhead transporting belts are necessary, and freedom of access from above is thereby not available and the depositing device is substantially more costly to construct.

In such devices, a further disadvantage arises because of the winding on and winding off process in that the outer diameter of the winding roller changes in the work process and there is a relatively great height through which the veneer pieces must move during the deposition thereof due to the large required outer diameter.

Accordingly, the present invention is directed toward provision of a device of the type described wherein planar or sheet material or workpieces may be transported in a satisfactory manner to a point of deposition without additional transporting belts or manual displacement so that they may be deposited without moving through an excessive vertical distance.

SUMMARY OF THE INVENTION

Briefly, the present invention may be described as a mechanism for deposition of sheet material such as veneer pieces comprising belt means defining a generally horizontal support surface for the sheet material, first and second roller means having said belt means extending thereabout, tensioning means applying a force holding the belt means taut about the first and second roller means and means for reciprocally moving one of the first and second roller means relative to the other thereby to expand and contract the length of the support surface. Additionally, clamping means are provided for holding the belt means stationary relative to the other of said first and second roller means and the tensioning means may be in the form of a weight tending to apply a downward force on the belt means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
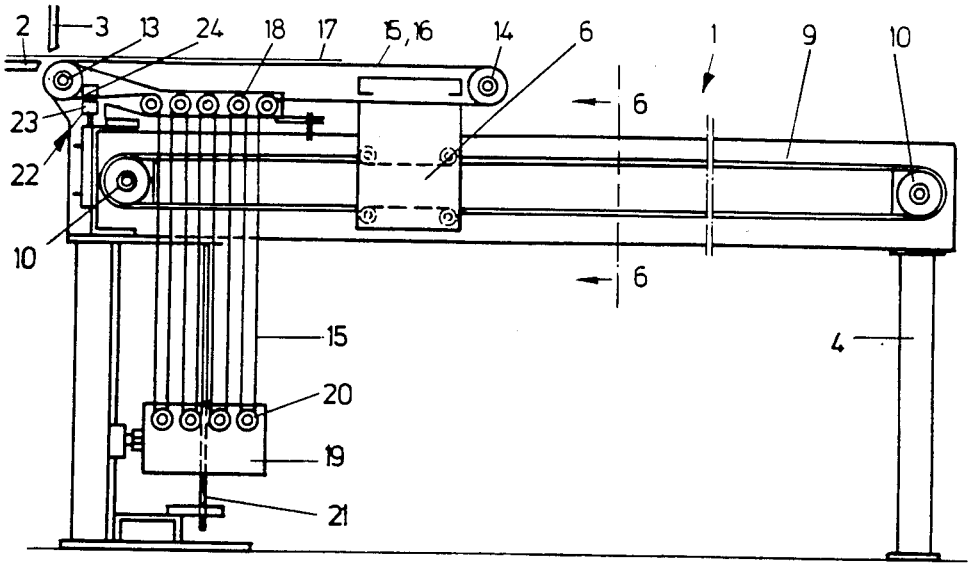
FIG. 1 is a schematic side view showing a mechanism in accordance with the invention.

Referring now to the drawings wherein similar parts are identified with like reference numerals throughout the various figures thereof, there is shown a mechanism 1 for transporting and depositing sheet material with the mechanism 1 being arranged in operative association with a feed or transporting device for delivering planar workpieces or sheet material which in the embodiment shown specifically comprise veneer pieces. Schematically shown in the drawings in cooperative arrangement with the transporting and depositing device 1 are a transporting device 2 for delivering the sheet material and a cutting device 3 for severing workpieces from the incoming sheet material.

In the operation of the device depicted in the drawings, and referring particularly to FIGS. 1 and 3–5, sheet material 17 is delivered from the transporting device 2 past the cutting device 3 toward the right into operative association with the depositing device 1.

Figure 2:
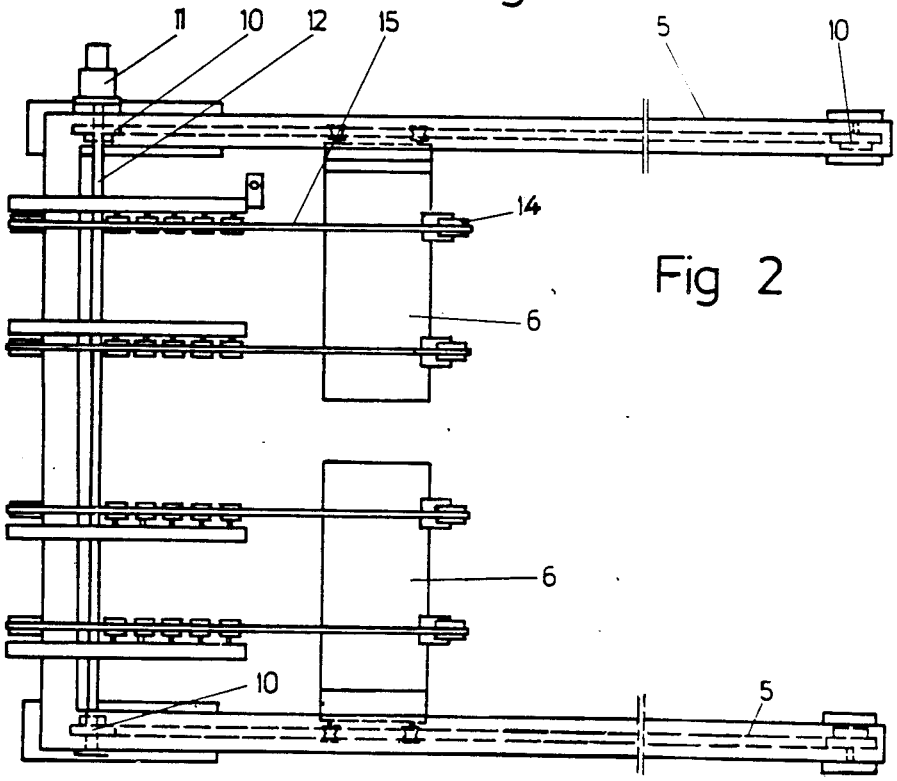
FIG. 2 is a schematic top view of the mechanism shown in FIG. 1.

The depositing device 1 comprises a frame 4 which, as seen from above in FIG. 2, has a U-shaped configuration including a pair of side pieces 5.

Figure 6:
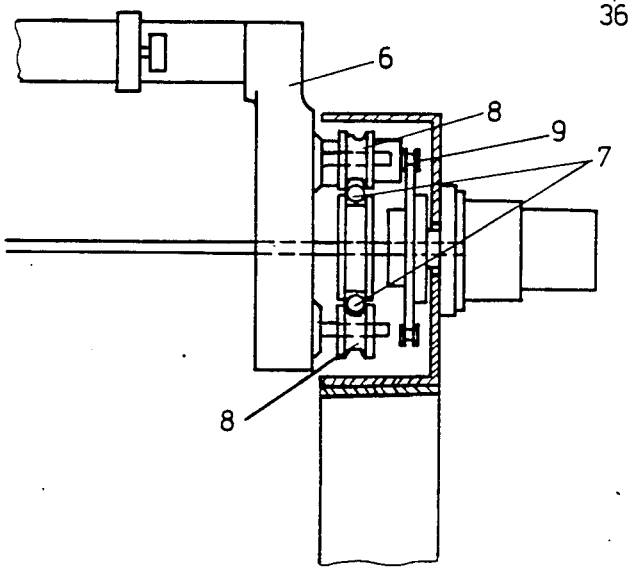
FIG. 6 is a view taken through the line 6—6 in FIG. 1 showing parts of the mechanism on an enlarged scale.

The mechanism also includes at least one sled 6 which is longitudinally displaceable, with two sleds 6 being shown in FIG. 2. The support mechanism for the sleds 6 is depicted in FIG. 6 and is shown as comprising longitudinal guides 7 on which the sleds 6 are guided by means of rollers 8 so as to be easily longitudinally displaceable and resistant to tilting. A chain 9 is fastened at the sled 6.

As can be seen from FIG. 1, the chain 9 runs over a pair of chain wheels 10 with the chain wheels being driven by means of a drive mechanism 11 having adjustable speed, preferably utilizing an adjustable electric motor. The chain wheels 10 are arranged on either side of the frame 4 in the side pieces 5 and are driven simultaneously. It is also possible to provide individual drives 11 for each of the sleds 6.

The mechanism further comprises two endless belts 15 which extend between deflection rollers 13 and deflection rollers 14. The deflection rollers 13 are fastened at the input side of the frame 4 and the deflection rollers 14 are fastened to a sled 6. The endless belts 15 are arranged with an upper run and a lower run about the deflection rollers 13, 14 with the upper run of each belt 15 defining a support surface 16 for the sheet material or workpieces 17. As previously indicated, the workpieces 17 may be veneer pieces.

Additional deflection rollers 18 are fastened one behind another at the frame 4 for each of the belts 15 and deflection rollers 20 are also arranged beneath the deflection rollers 18. A vertically movable weight 19 is provided at the deflection rollers 20 and the lower run of each of the belts 15 is accordingly arranged in a multiple track arrangement between the deflection rollers 18 and 20 so as to run in the vertical direction. The weight 19 is guided at a rod or bar 21 and is secured against rotation relative to the frame 4 and serves the purpose of length equalization during displacement of the sleds 6 and for tensioning the belt 15.

Directly behind the deflection roller 13, there is provided a clamping mechanism 22 which is arranged at the support 4 by means of which each belt 15 may be secured during the return movement of the sled 6.

The clamping arrangement 22 is preferably composed of an elastically, hydraulically or pneumatically actuatable pressure member 23 and a counter member 24 with the pressure member 23 operating to press or clamp the belt against the counter member 24.

Figure 3:
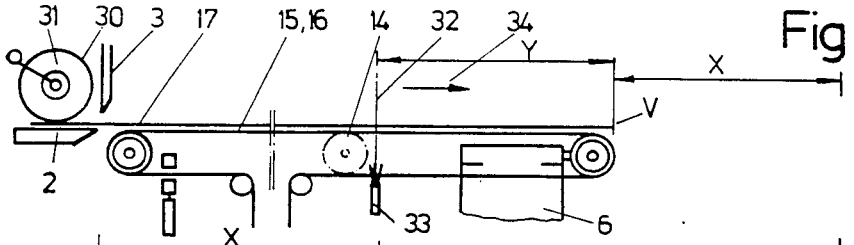
FIGS. 3, 4, and 5 are schematic side views showing the mechanism in three different operating positions during the process of depositing workpieces.

As will be seen from FIG. 3, a roller 30 is provided which presses upon the sheet material 17 and which is arranged at the end of the transporting device 2 with the roller 30 being driven by means of the forward feed movement of the workpiece to actuate a pulsed counter 31 connected therewith.

The pulsed counter 31 is in operative connection with a control mechanism (not shown) of the cutting device 3 and with an adjusting and controlling device for the adjustable drive 11 of the sleds 6.

Figure 4:
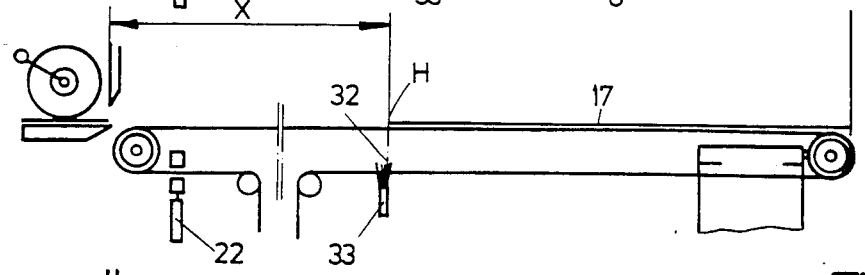
Figure 5:
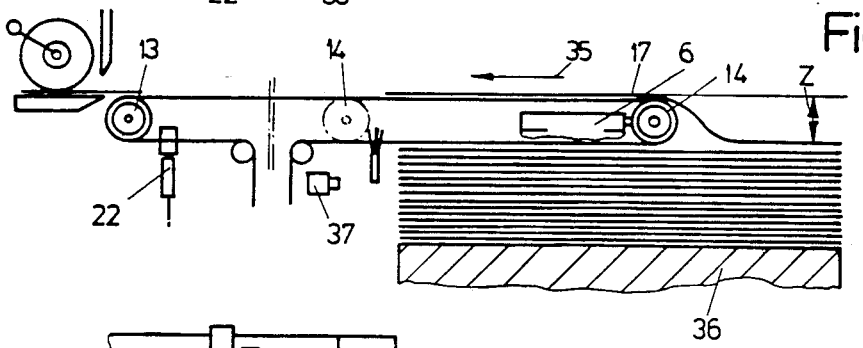

In the operation of the mechanism of the present invention, during the deposition process, and as seen more clearly from FIGS. 3–5, the sheet material 17 which may be composed of a sheet of material useful as veneer pieces, is moved in sliding engagement on the support surface 16 of the depositing device 1, the support surfaces 16 being formed or defined by means of the belts 15. The sheet material 17 is moved forwardly or to the right as indicated by the arrow 34 in FIG. 3 by the transporting device 2 until a front edge V of the sheet material 17 reaches a light barrier 32 of a photocell 33. Simultaneously, the forward feed speed is measured by means of the pulsed counter 31.

The sleds 6 are located in the starting position shown in FIG. 3 wherein the deflection rollers 14 which are attached to the sleds 6 are located in front of the photocell 33, as indicated in dash-dot line in FIG. 3. When a signal is generated by the photocell 33, the sleds 6 are set in motion in the direction of the arrow 34 synchronously with the forward feed speed and the support surfaces 16 defined by the belts 15 will assume the same speed and ensure satisfactory forward transportation of the workpieces or veneer belt material, respectively. The weight 19 is raised or lowered during this forward movement and therefore constitutes tensioning means for maintaining the belt 15 taut about the rollers 13 and 14.

After the sheet material 17 has moved through a distance Y, a veneer piece or sheet 17 is cut at the position of the sled shown in FIG. 3 by means of the cutting device 3 and a signal for the cutting process is effected by means of the pulsed counter 31 when an adjusted length value of the sheet material 17 is achieved.

After the cutting process, the sleds 6 are moved further forwardly in the direction 34, preferably at an increased speed, through a distance corresponding to the distance X until a rear edge H of the workpiece or veneer piece 17 reaches the photocell 33. The drive of the sleds 6 is then stopped by means of a corresponding signal from the light barrier 32 and the depositing device 1 has then reached the working position shown in FIG. 4.

As will be seen from FIG. 5, the clamping arrangement 22 is then subsequently actuated and the sleds 6 are reciprocally moved backwardly in a direction corresponding to the direction 35 with an adjustable speed. During this process, the belts 15 are held secure so that the support surfaces 16 are stationary relative to the frame 4. The sheet members or workpieces 17 are thereby securely deposited upon a lifting platform 36 so as to form a stack of veneer pieces with the lifting platform being advantageously lowered by a corresponding amount each time that one or more deposition cycles is completed.

The sleds 6 then move back to their starting position wherein a termination switch 37 generates a signal to stop and disengage the clamping arrangement 22.

Subsequently, a new deposition process as described above is initiated and effected.

Since the deflection rollers 13 and 14 may be constructed with a relatively small diameter, the vertical distance Z or depositing height, as seen in FIG. 5, through which the workpieces 17 fall during the deposition process can be relatively small thereby ensuring a satisfactory depositing of the workpieces without requiring that they be moved, displaced or pushed.

Since, during the forward movement of the sleds, the relative movement of the support surfaces relative to the sled is equal to zero, wherein the movement runs synchronously with the forward speed movement until the cutting process, a satisfactory transportation of the workpieces from the previous position to the depositing location is ensured without additional transporting means and without a pushing or sliding process which could cause friction.

Thus, from the foregoing, it will be seen that the present invention essentially provides a depositing device or mechanism including sleds 6 which can move reciprocally and which are arranged at a frame 4 wherein a continuous belt 15 runs between deflection rollers 13 fastened at the frame and deflection rollers 14 fastened at the sleds 6. The upper seam or run of each of the belts 15 forms a support surface 16 for workpieces to be deposited and a compensating weight or tensioning means 19 is arranged intermediately in the lower seam or run of the belt 15. During forward movement of the sleds, relative movement of the support surfaces 16 relative to the sleds 6 is equal to zero so that the workpieces are transported further to the depositing location. During rearward movement of the sleds, the belts 15 are securely held by means of the clamping device 22 so that relative movement of the support surfaces 16 relative to the frame 4 is zero thereby ensuring a satisfactory depositing process.

While a specific embodiment of the invention has been shown and described in detail to illustrate the application of the inventive principles, it will be understood that the invention may be embodied otherwise without departing from such principles.

What is claimed is:

1. Apparatus for cutting planar workpieces and for depositing said cut workpieces in a stack comprising:

means for feeding said workpieces;

means for cutting said workpieces;

belt means defining a generally horizontal support surface receiving said workpieces from said feeding means;

first and second support roller means having said belt means extending thereabout with said belt means arranged to define said horizontal support surface on one side thereof between said first and second support roller means;

a fixed support frame having said first support roller means mounted thereon;

sled means mounting said second support roller means on said frame means for reciprocal movement relative to said first support roller means to expand and contract the length of said support surface;

tensioning means connected with said belt means for applying to said belt means a tensioning force holding said belt means taut about said first and second roller means;

clamp means engaging said belt means to prevent relative movement of said belt means about said first support roller means at least during movement of said second support roller means relative to said first support roller means in one direction; and sensing means for sensing the position of said workpieces on said belt means;

said apparatus operating in response to said sensing means for controlling operation of said cutting means, said sled means and said clamp means to effect cutting of said workpieces to a predetermined length and deposition of said cut workpieces in said stack by reversed movement of said sled means and simultaneous actuation of said clamp means.

2. An apparatus according to claim 1, wherein said tensioning means comprise weight means mounted for vertical movement relative to said frame means connected with said belt means applying a downward force on said belt means.

3. An apparatus according to claim 2, further comprising additional roller means having said belt means extending thereabout, said additional roller means being mounted on said weight means for vertical movement therewith relative to said frame means.

4. An apparatus according to claim 1, wherein said clamp means selectively engages said belt means to clamp said belt means fixed relative to said first support roller means to prevent relative movement of said belt means about said first support roller means only during movement of said second support roller means toward said first support roller means.

5. An apparatus according to claim 1, wherein during movement of said second support roller means away from said first support roller means, said belt means is arranged so as to not undergo relative movement about said second support roller means but to be freely movable about said first support roller means.

6. Apparatus according to claim 1, wherein said clamp means operates to secure said belt means so that relative movement of said belt means relative to said second support roller means is equal to zero during movement of said second support roller means away from said first support roller means and so that movement of said belt means relative to said first support roller means is equal to zero during movement of said second support roller means toward said first support roller means.

7. Apparatus according to claim 1, further comprising drive means for driving said sled means for reciprocal movement relative to said frame means for effecting said reciprocal movement of said second support roller means, said sensing means operating to sense the position of a workpiece on said support surface for synchronizing movement of said sled means with movement of said workpiece prior to actuation of said cutting means to cut said workpiece to said predetermined length.

8. Apparatus according to claim 1, wherein said sensing means include pulse counter means for providing an indication of the length of a workpiece fed to said support surface to determine said predetermined length to which said workpieces are to be cut.

9. Apparatus according to claim 7, wherein said belt means comprise two belts and wherein said sled means comprise two sled members, one for each of said belts, said belts and said sled members being arranged adjacent each other.

10. Apparatus according to claim 9, wherein both of said sled members are driven in common by said drive means.

11. Apparatus according to claim 7, wherein after cutting by said cutting means, said workpiece is formed with a rear edge taken relative to the direction of travel thereof on said belt means and wherein said sensing means operates to sense arrival of said rear edge at a predetermined position and to actuate said control means to increase the speed of said sled means.

* * * * *